United States Patent [19]

Bulla

[11] 4,224,719

[45] Sep. 30, 1980

[54] RESERVE FIBRE SLIVER FEEDING APPARATUS

[76] Inventor: Beatrice Bulla, Via La Campagna, Serocca d'Agno, Switzerland

[21] Appl. No.: 23,073

[22] Filed: Mar. 23, 1979

[30] Foreign Application Priority Data

Mar. 30, 1978 [IT] Italy ..... 21774 A/78

[51] Int. Cl.[2] ..... D01G 23/00

[52] U.S. Cl. ..... 19/157

[58] Field of Search ..... 19/157, 159 R, 151, 19/240; 226/10, 11, 36

[56] References Cited

U.S. PATENT DOCUMENTS

| | | | |
|---|---|---|---|
| 1,626,954 | 5/1927 | Naumburg | 19/157 |
| 2,608,725 | 9/1952 | Strew | 19/157 |
| 3,315,321 | 4/1967 | Kobayashi et al. | 19/157 |
| 3,371,388 | 3/1968 | Dilles | 19/151 |

FOREIGN PATENT DOCUMENTS

| | | | |
|---|---|---|---|
| 2230644 | 12/1972 | Fed. Rep. of Germany | 19/157 |
| 41-2739 | 2/1966 | Japan | 19/157 |
| 42-14134 | 8/1967 | Japan | 19/157 |
| 43-16913 | 7/1968 | Japan | 19/240 |
| 135792 | 2/1960 | U.S.S.R. | 19/157 |
| 212798 | 10/1968 | U.S.S.R. | 19/157 |

*Primary Examiner*—Louis Rimrodt
*Attorney, Agent, or Firm*—Lon H. Romanski

[57] ABSTRACT

An apparatus for feeding a reserve fibre sliver, as in a can creel machine, is shown as having a first piston-cylinder assembly actuatable to first piston-extended and second piston-retracted positions; the piston in turn operatively carries a reserve sliver guide and a second piston-cylinder assembly actuatable to a piston-extended condition and a piston retracted condition whereby when in a piston-extended condition a leading portion is constrained thereby and against a reserve sliver guide to prevent motion by said reserve sliver and whereby when in a piston-retracted condition the reserve sliver is free to move relative to the guide; the second piston-cylinder assembly, the guide and the reserve sliver held against the guide are moved, to a point in close proximity to the path of travel of a particular broken or run-out sliver, by the first piston-cylinder assembly when such is in the first piston-extended position; and the second piston-cylinder assembly, the guide and the reserve sliver carried within the guide are moved linearly away from the point of close proximity by the first piston-cylinder assembly when such is in the second piston-retracted position.

14 Claims, 7 Drawing Figures

RESERVE FIBRE SLIVER FEEDING APPARATUS

FIELD OF INVENTION

This invention relates generally to the field of feeding fibre slivers and the like, as in, for example, can creels and more particularly apparatus associated therewith for feeding replacement or reserve slivers to those portions or positions where a normal or active sliver has either broken or run-out.

BACKGROUND OF THE INVENTION

Heretofore the prior art has proposed various forms and embodiments of sliver feeding arrangements for use as in combination with related textile machines. Also, the prior art has proposed various arrangements by which reserve slivers were to be temporarily introduced into such sliver feeding arrangements to thusly, temporarily, replace broken or run-out normal slivers. Some of such reserve sliver feeding means depended upon gravity to move the leading portion of the reserve sliver to the intended location; others relied upon a power feed wherein a substantial length of lead portion of such reserve sliver was fed out and hopefully onto the proper location where the active sliver was to be substituted for while still others relied upon blasts of air to position and locate the leading portion of the reserve sliver.

Such prior art reserve sliver feeding devices and arrangements have been found to be generally unsatisfactory in that often the lead portion of the reserve sliver, in such prior art arrangements, has to be of substantial free length being supported at a point whereby the unsupported lead portion tends to dangle or otherwise lack proper or sufficient stability to prevent such reserve sliver lead portion from becoming caught by the related drive rollers or means at an incorrect relative location or from becoming caught by and aligned with a still active continuous sliver instead of being aligned with the broken or run-out sliver.

Accordingly, the invention as herein disclosed and described is primarily directed to the solution of the prior art problems associated with said reserve sliver feeding arrangements as well as other related and attendant problems.

SUMMARY OF THE INVENTION

According to the invention a reserve sliver feed arrangement comprises a supply of reserve sliver, guide means for receiving and guiding said reserve sliver, first means for at times holding said reserve sliver against movement relative to said guide means, and second means operatively supporting said guide means and said first means, said second means being effective to at the occurrence of a break or run-out in an active sliver to move said guide means and first means into close proximity to the trailing portion of said broken or run-out sliver and said first means being effective at that time to release said reserve sliver enabling said reserve sliver to operatively engage and be pulled by said trailing portion of said broken or run-out sliver.

Various general and specific objects, advantages and aspects of the invention will become apparent when reference is made to the following detailed description of the invention considered in conjunction with the accompanying drawings.

BRIEF DESCRIPTION OF THE DRAWINGS

In the drawings, wherein for purposes of clarity certain details and/or elements may be omitted.

DETAILED DESCRIPTION OF THE PREFERRED EMBODIMENT

Figure 1:
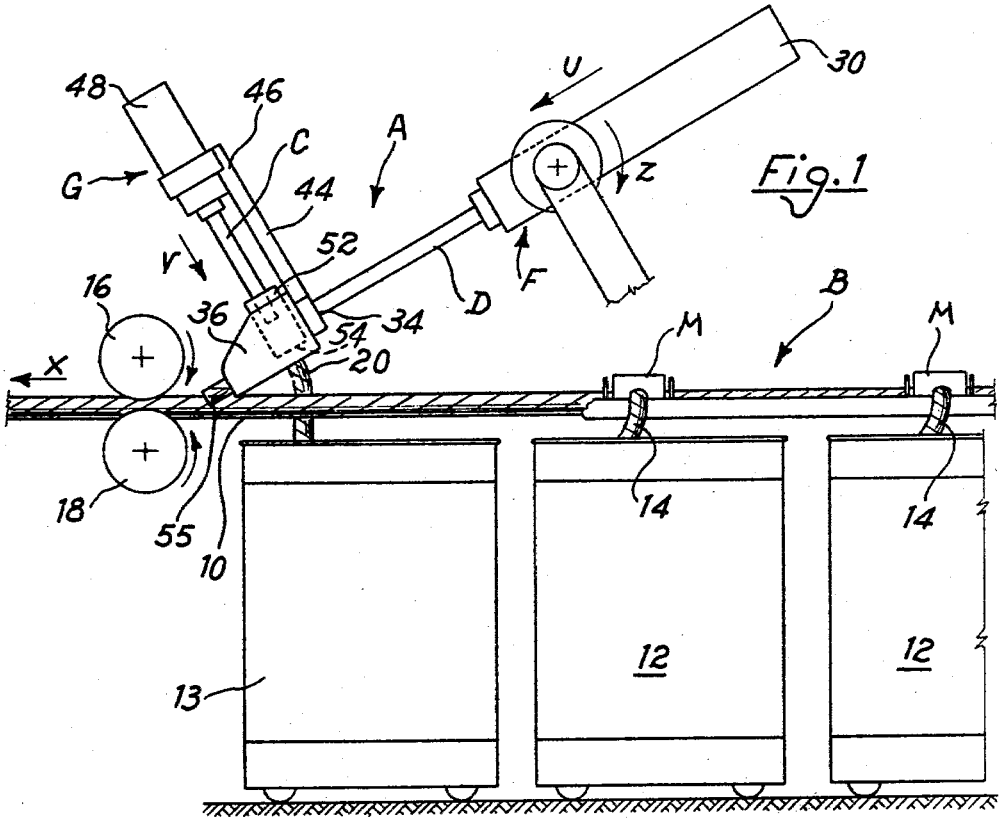
FIG. 1 is a fragmentary side elevational view of apparatus employing teachings of the invention.

Referring now in greater detail to the drawings, a creel assembly B is illustrated as comprising table means 10 along with a plurality of cans or housings 12 and at least one can or housing 13. The cans 12 contain supplies of normal active slivers or bands 14 while can 13 contains a reserve sliver or band 20.

As generally depicted in FIG. 1, preferably, pressure roller means M are carried by the creel assembly B as to have the respective normal active slivers 14 pass therethrough. The purpose of such means M (also serving as means for detecting the occurrence of a break in the respective normal active slivers or the run-out of said normal active slivers) and the operation thereof may be that as disclosed pending U.S. Patent Application Ser. No. 832,360 Filed Sept. 12, 1977, and in particular as illustrated at FIGS. 7, 8, 9, 12*a*, 12*b* and 12*c*.

Figure 2:
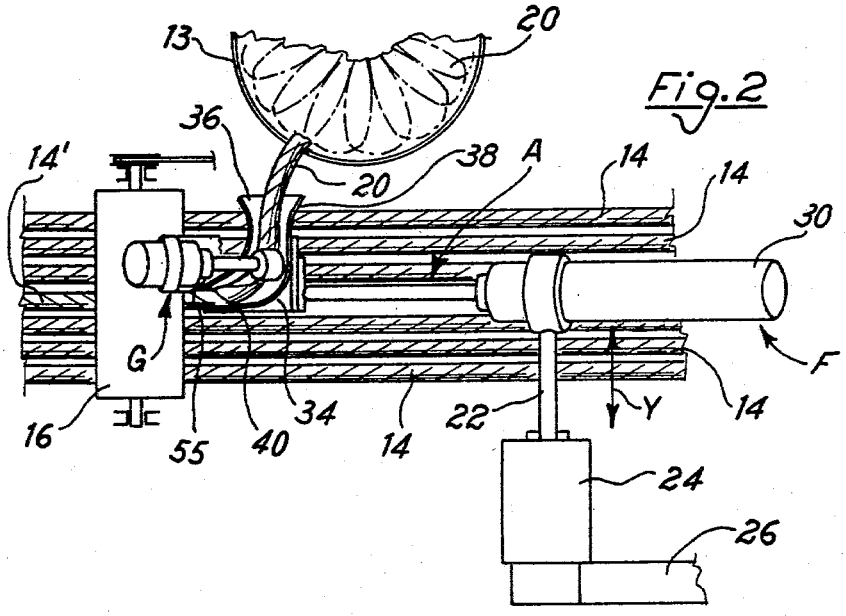
FIG. 2 is a fragementary top plan view of the apparatus of FIG. 1 taken as on a horizontal plane above FIG. 1 and looking downwardly at the apparatus of FIG. 1.

Generally, in the preferred embodiment of the invention, as the normal sliver 14 leaves its respective can 12, the sliver 14 passes through the roller detector means M and then through suitable directional travel changing means, such as rollers, pivot posts or the like, travels generally longitudinally along the creel table means 10. As also depicted in FIG. 2, it is contemplated that a plurality of such individual active slivers 14 will be simultaneously pass or move along table means 10 and that, preferably, at least during a portion of such movement, the paths of movement of the respective moving slivers will be at least generally parallel to each other.

A pair of pulling or driving cylinders or rollers 16 and 18 are suitably driven and operatively engage therebetween said moving slivers 14 so that rotation of drive means 16 and 18 (in the directions indicated by the arcuate arrows) causes movement of the slivers 14 (and as will be seen sliver 20) in the direction of arrow X toward the associated receiving means such as related textile machine means.

The reserve sliver guide and feeding means, A, is illustrated as comprising a pair of piston-cylinder assemblies F and G which cooperate with each other in at times presenting the forward end 55 of the reserve sliver 20 to the area of the then missing normal sliver.

In the preferred embodiment of the invention, each of the piston-cylinder assemblies F and G is pneumatically operated and, even though not shown, it will be obvious to those of ordinary skill in the art that such assemblies F and G would be operatively connected through suitable conduitry and valving means to a related source of superatmospheric pneumatic pressure and that such valving means would or could be controlled as through related electrical means actuated in response to such parameters as, for example: any of means M detecting the presence or absence of a normal active sliver; effective extension or withdrawal of the piston in assembly F; and extension or withdrawal of the piston in assembly G.

Figure 3:
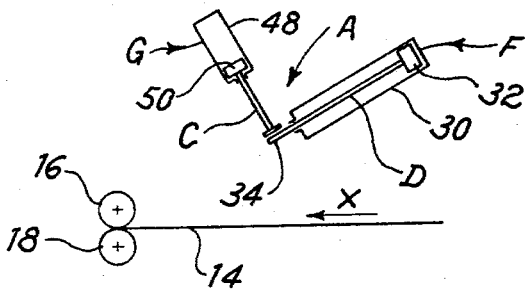
FIGS. 3, 4, 5, 6 and 7 are each somewhat simplified and somewhat diagrammatic views illustrating various phases or conditions of operation of the apparatus shown in FIGS. 1 and 2.

Referring to FIGS. 1, 2 and 3, assembly F is illustrated as comprising a cylindrical housing 30 containing a pressure responsive piston 32 which, in turn, has a piston rod or extension D movable therewith. The housing 30 is suitably supported as by a shaft-like portion 22 to suitable bearing or support block 24 which, in turn, is carried by the creel machine frame, a portion of which is fragmentarily illustrated at 26. The rod or shaft-like support 22 provides for rotatable or pivotal adjustment of housing 30, about the axis of shaft 22 and as generally indicated by arrow Z (as well as opposite thereto) in FIG. 1. The rod or shaft-like support 22 also provides for movement of the housing 30 in directions generally laterally or transversely of the table means 10 and generally laterally or transversely of the generally parallel strands or slivers 14; such lateral or transverse movement of housing 30 being diagrammatically indicated in FIG. 2 by the double arrow Y. Accordingly, as it should now be apparent, the angle at which the piston 32 and extension D move with respect to the table means 10 and the slivers 14, as viewed in FIG. 1, can be adjustably selected by virtue of pivotal adjustment of housing 30 about the longitudinal axis of rod or shaft 22. Further, it should also be apparent, that such adjustments (angular about the axis of member 22 and transversely of strands or slivers 14 as indicated by double arrow Y) enable, as will be further described, the end 55 of reserve strand or sliver 20 to be positioned exactly for feeding onto the broken or run-out end of a normal sliver which, in FIG. 2, is depicted at 14'.

In the preferred embodiment, cylinder 30 is rigidly secured against longitudinal movement while piston 32 carried therein is moved as by the application thereacross of a pneumatic pressure differential which, as is well known in the art, may be the result of, for example, the application of a superatmospheric pressure to one axial end of said piston through suitable porting or passage means formed in said cylinder 30. As is often the case, and is also well known in the art, the piston cylinder assembly F may be provided with suitable resilient or spring means (not shown) operatively engaging extension D and/or piston 32 for resiliently urging the extension D and/or piston 32 in a direction opposite to that movement of piston 32 caused by the said pressure differential when created thereacross.

Further, as best shown in FIGS. 1 and 2, in the preferred embodiment the extending or free end of extension D is provided with a support-like portion 34 which, in turn, carries a guide-like member 36 comprising a first portion 38 extending generally transversely of the slivers 14 (or paths of movement of such slivers 14), when viewed from above and as generally shown in FIG. 2, and a second portion 40 extending generally parallel to the slivers 14 (or paths of movement of such slivers 14), when viewed from above and as generally shown in FIG. 2. Each of such portions 38 and 40 are preferably of a trough-like configuration so that when viewed in transverse cross-section each have a generally U-shaped configuration. As shown in each of FIGS. 1 and 2, the reserve strand or sliver 20 has its lead portion situated in the trough-like guide 36 as to have, preferably, the lead end 55 thereof extending somewhat beyond the open end of guide portion 40 of member 36.

As best seen in FIG. 1, in the preferred embodiment, member or support 34 operatively carries a second support portion or member 46 which, in turn, supports or carries a second cylinder-piston assembly G which comprises cylinder means 48 containing an axially movable pressure responsive piston means 50 operatively connected to or carrying a rod-like extension C. As with regard to piston-cylinder assembly F, the assembly G may be pneumatically operated so that upon admission of, for example, a superatmospheric pressure to one axial end or side of piston means 50 such piston means 50 and extension C are caused to axially move in the direction of force resulting from the pressure differential created by the application of said assumed superatmospheric pressure. Further, resilient or spring means (not shown but well known in the art) may be employed, if desired, for resiliently urging the piston 50 and extension C in a direction opposite to that direction of movement caused by said pressure differential. Obviously, if desired either or both piston-cylinder assemblies F and G may of the type whereby movement of the pistons and extensions in both directions, as generally depicted by the arrow-V (and opposite thereto) in FIG. 1, is achieved by the selective application of pressure differentials resulting in forces directed in such directions.

The end 46 of support 44 is operatively fixedly secured to housing or cylinder means 48 as to, preferably, position the effective axis of piston-cylinder assembly G generally perpendicular to the longitudinal axis of extension D as to enable a pressure pad or member 54, carried at the free end 52 of extension C to be generally received by the guide member 36 when extension C is extended (by actuation of piston means 50) and as generally illustrated in, for example, FIGS. 1 and 2.

OPERATION OF INVENTION

During normal operation, the drive or feed roller means 16 and 18 are in operative engagment with the plurality of normal or active strands or slivers 14 respectively being fed out of the plurality of cans 12 (or the like) and as through the primary guide rollers and detector means M. During such operation the leading portion of reserve strand or sliver 20 will be situated in the guide member 36 as generally depicted in FIGS. 1 and 2. Also during such operation, the piston 50 and extension C, of assembly G, will be actuated as to be in an extended condition, as generally depicted in FIG. 3, thereby causing the pressure pad 54 to be applied against the leading portion of reserve strand or sliver 20 causing such leading portion of reserve sliver 20 to be held stationary against the coacting guide member 36. Further, during such normal operation, piston means 32 and extension D thereof are effectively withdrawn as to assume a position as also generally depicted in FIG. 3. It should be remembered that the guide 36 and cylinder-piston assembly G move in unison with the piston 32 and extension D of piston-cylinder assembly F.

During such otherwise normal operation, a particular active or normal strand or sliver 14 may either run-out or become broken. In both of such situations such a broken or run-out active sliver will have a trailing end, and, as such trailing end passes through the related or associated detector means M, suitable related signal means is generated indicating the absence of a particular active sliver. For purposes of illustration, and with reference to FIG. 2, such an assumed broken or run-out sliver is depicted at 14' so that, for example, a vacancy or space would, except for the invention, otherwise occur between three active strands 14 to either side thereof.

Figure 4:
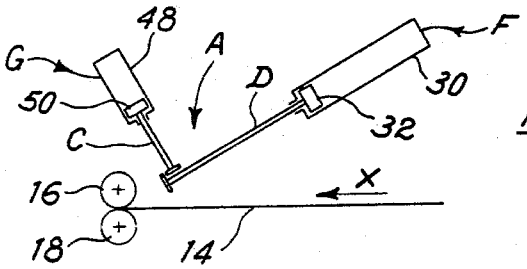

In any event, upon the occurrence of such a signal from the related detector means, such as M, indicating the occurrence of the absence of normal or active sliver, piston means 50 and associated extension C remain in an extended condition (as initially described with reference to FIG. 3) while piston means 32 and related extension D are actuated to an extended condition thereby resulting in such extension D and piston-cylinder assembly G assuming positions as depicted in FIG. 4. At such initial movement to the FIG. 4 position, the leading portion of the reserve sliver 20 is still held against movement by the pressure pad or retainer means 54. The said (somewhat diagrammatic) FIG. 4 position corresponds to FIG. 1 wherein the various elements, including end 55 of the leading portion of reserve sliver 20, are shown in greater detail. In any event, by virtue of piston 32 and associated extension D being thusly extended, the end 55 of reserve sliver 20 is placed in a position closely approaching a substantially coplanar condition with the other active slivers 14 and, transversely, in alignment (when viewed from above and shown in FIG. 2) with the path of movement of the assumed broken or run-out active or normal sliver 14'.

Figure 5:
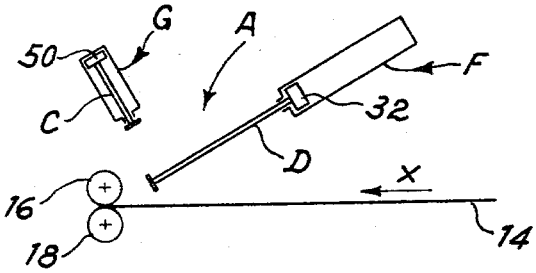

Subsequent to the apparatus attaining the relative positions depicted in FIG. 4, the piston-cylinder assembly G is actuated as to cause the piston means 50 and associated extension C to be generally drawn into the cylinder housing 48, to positions depicted in FIG. 5, as to thereby result in the leading portion of reserve sliver 20 being released by the pressure pad or holding means 54 carried by extension C. As a consequence of thusly being released by restraining means 54 and, further, as a consequence of end 55 of reserve sliver 20 being physically placed in alignment with the path of movement of the assumed normal sliver 14' and thereby frictionally engaging the trailing portion of said sliver 14' as well as frictionally engaging the active slivers 14 on each side of the path of movement of sliver 14', reserve sliver 20 is, by such experienced frictional forces, pulled through the guide member 36, out of the reserve supply container 13, and fed between drive means or rollers 16 and 18. As a result, the leading portion of reserve sliver 20, in effect, slightly overlaps the trailing portion of the broken or run-out active sliver 14' thereby assuring continuity of the bands or slivers being fed as to the associated textile machine.

Figure 6:
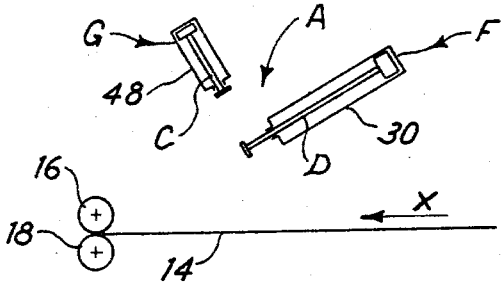

After a preselected span of time, the piston-cylinder assembly F is actuated as to cause piston 32 and associated stem or extension D to move generally inwardly of cylinder housing 30 to a position as generally depicted in FIG. 6. During such movement, however, the piston 50 and stem or extension C of cylinder-housing assembly G remain in their respective withdrawn conditions as previously assumed in the FIG. 5 illustration, except, of course, that the entire assembly G moves with extension D as it generally withdraws into cylinder housing 30. Since the pressure pad or restraining means 54 is held away from that portion of the reserve sliver 20 passing through the guide 36, the said reserve sliver continues to be drawn through the guide 36 the only major difference being that there is now a greater space as between the exit end of guide 36 and the point of entry of the reserve sliver 20 into or between drive rollers 16 and 18. The reserve sliver 20 continues to be fed through the funnel-like guide 36 and into rollers 16 and 18 (from the upstream side thereof) with the apparatus in the FIG. 6 condition until the broken or run-out active or normal sliver 14' is reintroduced into the operation.

Figure 7:
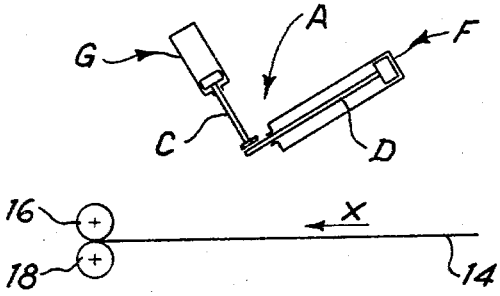

When an active or normal sliver 14 is reintroduced (to replace the reserve sliver 20 which, in turn, is temporarily replacing the broken or run-out sliver 14') it, in the embodiment shown, passes through the related associated detector means M which, of course, again detects the presence of an active sliver and in so doing creates a related output indicative thereof. As a consequence of such related output two things happen. That is, the related control means causes the piston-cylinder assembly G to be actuated as to result in piston 50 and extension or stem C to become extended, to the FIG. 7 positions, thereby causing the pressure pad or restraining means 54 to engage that portion of reserve sliver passing through the funnel-like guide 36, and, associated sliver cutting means (not shown but many of which are well known in the art) is activated causing such sliver cutting means to cut the reserve sliver 20 relatively close to but spaced from the exit end of the funnel-like guide 36. The timing of such cutting is, of course, such as to permit the leading portion of the reintroduced sliver 14 to be partly overlapped by the trailing portion of the cut reserve sliver 20 thereby assuring the existing continuity of the slivers to the associated sliver receiving structure as, for example, textile machine means. As is evident, once the reserve sliver 20 is thusly cut, assemblies G and F, as depicted in FIG. 7 correspond to the positions of the same assemblies G and F as depicted in FIG. 3, namely, ready for the next occurrence of a break or run-out in sliver 14'.

As should be evident, the invention provides an arrangement whereby a relatively short section of the lead portion of a reserve sliver can be brought into operative engagement with the trailing portion of an active or normal broken or run-out sliver in such a manner as to preclude the possibility of having the reserve sliver become entangled as with an active sliver which is not broken or run-out. That is, some prior art methods of introducing a reserve sliver employed an arrangement whereby the lead portion of the reserve sliver was relatively long and free to generally dangle from a related support. At times such dangling portion of the reserve sliver would become caught or accidentally fed into the related drive rollers at a relative location thereof which did not correspond to the location of the related broken or run-out sliver. The invention overcomes this problem in a simple and reliable manner.

It is also contemplated that a plurality of such reserve sliver guide and feed means may be employed in a single creel machine as where a plurality of reserve sliver sources are employed.

Other embodiments and modifications are, of course, possible. For example, it is conceivable that either or both of the piston-cylinder means G and F could be replaced as with solenoid means or the like.

Although only a preferred embodiment of the invention has been disclosed and described, it is apparent that other embodiments and modifications of the invention are possible within the scope of the appended claims.

What is claimed is:

1. A sliver feeding arrangement for simultaneously feeding a plurality of moving active slivers to related textile machine means, comprising a plurality of first sources for providing a plurality of said active slivers, each of said first sources providing at least one active sliver, means for guiding each of said plurality of active slivers in their movement in predetermined paths so that said active slivers during at least a portion of said paths are moving generally parallel to each other, means for operatively engaging said active slivers as to draw said active slivers from said first sources, move said active slivers along said paths and feed said active slivers toward said textile machine means, a second source for providing a reserve sliver, guide means for operatively engaging and guiding said reserve sliver, restraining means effective to at times operatively engage and hold said reserve sliver against movement relative to said guide means, transporter means operatively supporting said guide means and said restraining means, detecting means effective to detect the existance of each of said plurality of said active slivers and being further effective to detect the occurrence of a break or run-out in any of said plurality of said active slivers, said transporter means being effective upon said detecting means detecting the occurrence of a said break or run-out to transport said guide means and said restraining means to a first position of close proximity to said predetermined paths as to thereby present a leading portion of said reserve sliver carried by said guide means to a trailing portion of the detected broken or run-out sliver, and said restraining means being effective upon being transported to said first position to release said reserve sliver and permit said reserve sliver to move relative to said guide means and with said trailing portion of the detected broken or run-out sliver.

2. A sliver feeding arrangement according to claim 1 wherein after said restraining means releases said reserve sliver in said first position said transporter means is effective to transport said restraining means and said guide means away from said first position to a second position relatively distantly remote from said predetermined paths.

3. A sliver feeding arrangement according to claim 1 wherein after said restraining means releases said reserve sliver in said first position said transporter means is effective to transport said restraining means and said guide means away from said first position to a second position relatively distantly remote from said predetermined paths while said reserve sliver continues to move relative to said guide means.

4. A sliver feeding arrangement according to claim 1 wherein said restraining means comprises pressure responsive piston-cylinder means.

5. A sliver feeding arrangement according to claim 1 wherein said transporter means comprises pressure responsive piston-cylinder means.

6. A sliver feeding arrangement according to claim 1 wherein said restraining means comprises first pressure responsive piston-cylinder means, and wherein said transporter means comprises second pressure responsive piston-cylinder means.

7. A sliver feeding arrangement according to claim 1 wherein said transporter means when moving from said first position to said second position describes a path of movement therebetween which is inclined with respect to said predetermined paths of said active slivers.

8. A sliver feeding arrangement according to claim 1 wherein said transporter means is movable in directions generally transversely to said paths of movement of said plurality of active slivers.

9. A sliver feeding arrangement according to claim 1 wherein said transporter means is translationally movable in directions generally transversely to said paths of movement of said plurality of active slivers.

10. A sliver feeding arrangement according to claim 1 wherein said means for operatively engaging said active slivers as to draw said active slivers from said first sources comprises drive roller means operatively rotatably frictionally engaging said plurality of said active slivers, wherein said plurality of active slivers define upstream portions thereof about to be operatively engaged by said drive roller means and downstream portions thereof having been engaged by said drive roller means and moving away therefrom, and wherein said first position is one whereby said leading portion of said reserve sliver engages said trailing portion of said detected broken or run-out sliver at a point upstream of said drive roller means.

11. A sliver feeding arrangement according to claim 1 wherein said guide means comprises a trough-like member through which said reserve sliver is slidably guided.

12. A sliver feeding arrangement according to claim 1 wherein said guide means comprises at least first and second portions, wherein said first portion is generally transverse to the paths of movement of said plurality of active slivers, and wherein said second portion is generally parallel in at least one plane with the paths of movement of said plurality of active slivers.

13. A sliver feeding arrangement according to claim 1 wherein said transporter means comprises first pressure responsive piston-cylinder means, said piston-cylinder means comprising a first piston means and a first cylinder movable relative to each other, wherein said restraining means comprises second pressure responsive piston-cylinder means, said second pressure responsive piston-cylinder means comprising a second piston means and a second cylinder movable relative to each other, said first piston means being operatively connected to first extension means, wherein said guide means is operatively carried by said first extension means, wherein said guide means comprises guide surface means for slidably guiding thereagainst said reserve sliver, said second piston means being operatively connected to second extension means, wherein said second cylinder is operatively carried by said first extension means, wherein said second extension means comprises pressure-pad means, wherein said restraining means is effective for holding said reserve sliver against said movement relative to said guide means by causing said second extension to move said pressure-pad means to move against and engage said reserve sliver as to thereby hold said reserve sliver against said guide surface means, wherein after said restraining means releases said reserve sliver by moving said pressure-pad away from said reserve sliver said first piston means and said first extension means are effective to transport said second piston-cylinder means and said guide means away from said first position to a second position relatively distantly remote from said predetermined paths while said reserve sliver continues to move relative to said guide means and said guide surface means, wherein said first piston means and first extension means and said guide means when moving from said first position to said second position describe a path of movement therebetween which is linear and inclined with respect to said predetermined paths of said active slivers, wherein said means for operatively engaging said active slivers as to draw said active slivers from said first sources comprises driver roller means operatively rotatably frictionally engaging said plurality of said active slivers, wherein said plurality of active slivers define upstream portions thereof about to be operatively engaged by said drive roller means and downstream portions thereof having been engaged by said drive roller means and moving away therefrom, and wherein said first position is one whereby said leading portion of said reserve sliver engages said trailing portion of said detected broken or run-out sliver at a point upstream of said drive roller means.

14. Apparatus for presenting a reserve sliver for engagement with a trailing portion of a broken or run-out active sliver in a sliver supply arrangement for a textile machine means, comprising first reciprocatingly actuatable positioning means extensible to a first position and retractable to a second position, guide means operatively connected to and movable in accordance with said first positioning means as to thereby be movable to and from said first and second positions, said guide means being effective to carry and guide said reserve sliver, second reciprocatingly actuatable restraining means extensible to a first condition and retractable to a second condition, said second restraining means being operatively connected to and movable in accordance with said first positioning means as to thereby be movable to and from said first and second positions, said second restraining means being effective when in said first condition to hold said reserve sliver in said guide means and against movement relative to said guide means, wherein said first positioning means when in said first position causes said second restraining means and said guide means to be brought to a relatively closest relationship with said broken or run-out active sliver as to cause a leading portion of said reserve sliver to engage said trailing portion of said broken or run-out active sliver, and said second restraining means being effective upon being moved to said first position being effective to be actuated to said second condition thereby releasing said reserve sliver and permitting said reserve sliver to be pulled through said guide means as by said trailing portion of said broken or run-out active sliver.

* * * * *